United States Patent [19]

Roberts

[11] Patent Number: 4,921,245

[45] Date of Patent: May 1, 1990

[54] EXERCISE DEVICE

[76] Inventor: William J. Roberts, 46 Browne St., Brookline, Mass. 02146

[21] Appl. No.: 274,705

[22] Filed: Nov. 15, 1988

Related U.S. Application Data

[63] Continuation of Ser. No. 929,409, Nov. 10, 1986, abandoned.

[51] Int. Cl.[5] ..... A63B 1/00

[52] U.S. Cl. ..... 272/109; 272/61; 272/62; 272/DIG. 4; 272/93

[58] Field of Search ..... 272/109, 61, 62, 63, 272/DIG. 4, 144, 134, 85, 111-113, 139, 900, 93; 403/155, 154, 108, 372; 384/129, 299-301, 280, 282, 295, 296; 248/339, 341, 323, 324, 165, 163; 40/606, 612, 617

[56] References Cited

U.S. PATENT DOCUMENTS

| | | | |
|---|---|---|---|
| 618,990 | 2/1899 | Lubben | 272/900 X |
| 2,589,482 | 3/1952 | Downey | 403/379 |
| 2,944,815 | 7/1960 | Moyer | 272/62 |
| 3,069,945 | 12/1962 | Shandel | 403/108 X |
| 3,117,760 | 1/1964 | Dresbach et al. | 272/62 |
| 3,226,115 | 12/1965 | Underhill | 272/900 X |
| 3,473,801 | 10/1969 | Nissen et al. | 272/63 |
| 3,531,077 | 9/1970 | Trottier et al. | 384/129 X |
| 3,709,487 | 1/1973 | Walker | 272/134 |
| 3,815,180 | 6/1974 | DeHaai | 403/155 X |
| 3,874,657 | 4/1975 | Niebojewski | 272/109 X |
| 4,129,916 | 12/1978 | Schlesinger et al. | 272/62 X |
| 4,241,914 | 12/1980 | Bushnell | 272/62 X |
| 4,275,880 | 6/1981 | Murphy | 272/109 X |
| 4,412,753 | 11/1983 | Linn | 384/437 |
| 4,487,413 | 12/1984 | Fall | 272/109 X |
| 4,620,701 | 11/1986 | Mojden | 272/144 X |

FOREIGN PATENT DOCUMENTS

| | | | |
|---|---|---|---|
| 0573622 | 9/1977 | U.S.S.R. | 403/155 |

OTHER PUBLICATIONS

American '68 School Catalog; p. 24, 1968.

*Primary Examiner*—Richard J. Apley
*Assistant Examiner*—H. Flaxman
*Attorney, Agent, or Firm*—Thomas J. Engellenner

[57] ABSTRACT

An exercise device of the type having a horizontally disposed bar supported by a pair of uprights extending from a pair of base members and further supported from the base members by a pair of brace members supporting each of the uprights and a pair of crossmembers connecting the base members with extendable support means associated with the base members to be extended during large arc swinging on the device and to retracted or removed when the device is in a non-swinging mode or storage mode.

9 Claims, 18 Drawing Sheets

EXERCISE DEVICE

This application is a continuation of application Ser. No. 929,409, filed November 10, 1986, now abandoned.

BACKGROUND OF THE INVENTION

1. Field of the Invention

This invention resides in the field of user-movable and size-adjustable exercise devices. More particularly the invention relates to an exercise device allowing large swinging motions to be performed thereon within a room-sized area. The device of this invention may have some collapsible portions and when in a storage mode, can be used for other purposes.

2. Description of the Prior Art

Portable horizontal bars available in a variety of constructions are well known in the art. Some bars are installable in door frames, but these are generally unsuitable for wide arc body swinging exercises. To perform wide arc body swinging exercises, large movable devices have been designed for use within gymnasiums where they can be moved from one place to another for usage and storage. Other horizontal bar devices are structured such that when set up, they are secured by guy braces extending from uprights which support the horizontal bar, which guy braces are affixed to attachment members built into the floor of the gymnasium. The use of such bars for brachiating exercises such as extension, stretching, twisting, hanging, and swinging exercises and their inverted variations has long been recognized to help in the alignment of the skeleton and development of the musculature to attain and maintain ideal posture, coordination, equilibrium and strength. Such devices develop midcourse corrector musculature as well as core stabilizer muscles at the same time. Unfortunately one has had to go to a place such as a gymnasium to use such large devices where such devices are set up as such devices are impractical for use within the home as they require such a large space or structural alterations to the building containing them in order to set them up. Gymnastic rings which have similar fitness benefits are traditionally suspended from ceilings or 15 ft. high frameworks and thus have the same installation limitations as horizontal bars.

SUMMARY OF THE INVENTION

It is an object of this invention to provide a self-supporting, self-contained horizontal bar structure having extendable base members, such structure being suitable for exercises including large swinging motions from the horizontal bar or from devices such as rings suspended therefrom. The exercise device of this invention is especially adapted for free-standing use in confined areas such as normal-sized rooms so that it can be set up and used in one's home. When the device is placed in its storage mode, it can be either moved to a storage location within the room or, if desired, utilized for other functional purposes such as to support a swing, hammock or seat and thus can be utilized like a piece of furniture.

To accomplish the objectives of this invention, the device of this invention is self-stabilizing and incorporates a horizontal bar supported by upright members which are adjustable in height. The height of the horizontal bar and the distance apart of the uprights is proportioned to allow for the complete extension of the human physique in all directions. Each upright member in one embodiment can be affixed to an inner base member and can have a pair of supporting inclined braces, one on each side thereof. A pair of crossmembers connect the inner base members to prevent any separation thereof and to provide additional rigidity to the structure. In one embodiment elongated base members can be affixed to the exterior of the inner base members. These elongated base members can be removable. The elongated base members can incorporate base extension members therein. These base extension members can be withdrawn or extended as needed and in one embodiment can be telescoping portions adapted to fit within the elongated base member. The base extensions members, when extended, allow the user to swing in full arcs from the horizontal bar. The base extension members can in some embodiments extend approximately as far as the length of the body of the user when at a full extension swing to help support the horizontal bar. In another embodiment, the base extension members can further include extension braces for support which are adjustable to provide additional strength to the structure. Such extension brace members can be hinged at the end of each base extension member and can be made up of a lower extension brace telescopically adjustably positioned within an upper extension brace similar in manner to the way the base extension can be adjustable within the elongated base member. A leg member can be adjustably positioned at the end of the hinge of the base extension and lower extension brace members to raise or lower the height of that end of the structure. By adjusting both the base extension member and the lower extension brace member within the corresponding telescopically-receptive portions of the base and upper extension brace, the length of the base member can be extended or retracted.

When the device is in its storage mode, the base extensions are retracted within the elongated base or the elongated base can be removed, and a cot, swing, bed, hammock or any equivalent body-support member can be suspended from the horizontal bar as mentioned above. The suspension of such articles will allow the device of this invention to be utilized as a piece of furniture within a room. By supporting a swinging seat, bed or the like, the device of this invention has a multifunctional usage within a home environment.

The device of this invention can be manufactured to be disassembleable at a plurality of joints to be broken down to a number of pieces to allow for easy transportation and assembly within the home without the need for home alterations to bring the device into the house.

Many exercises can be done on the device of this invention in addition to brachiating exercises such as swinging thereon. Due to features such as multiple attachment points, the device can be used as a multiposition resistance strength trainer with elastic straps attached to the multiple attachment means on the crossbar, uprights and support frames. The multiple attachment means can include freely rotating eyebolts in receptacles to hold apparatus such as roller grip handles, stirrups, cuffs, straps, pulleys and the like which, in conjunction with the framework proportioned and stabilized allow complete freedom of movement and extension, facilitates stretching, alignment and unique new exercises that simultaneously combine stretching and strengthening.

A unique freely rotating overhead pivot bearing on the crossbar allows for smooth low friction pendulum swings to reduce stress and strain on muscles, joints and ligaments. The overhead pivot bearings have receptacles for attaching apparatus, a safety harness and suspended furniture.

DESCRIPTION OF THE PREFERRED EMBODIMENT(S)

Figure 1:
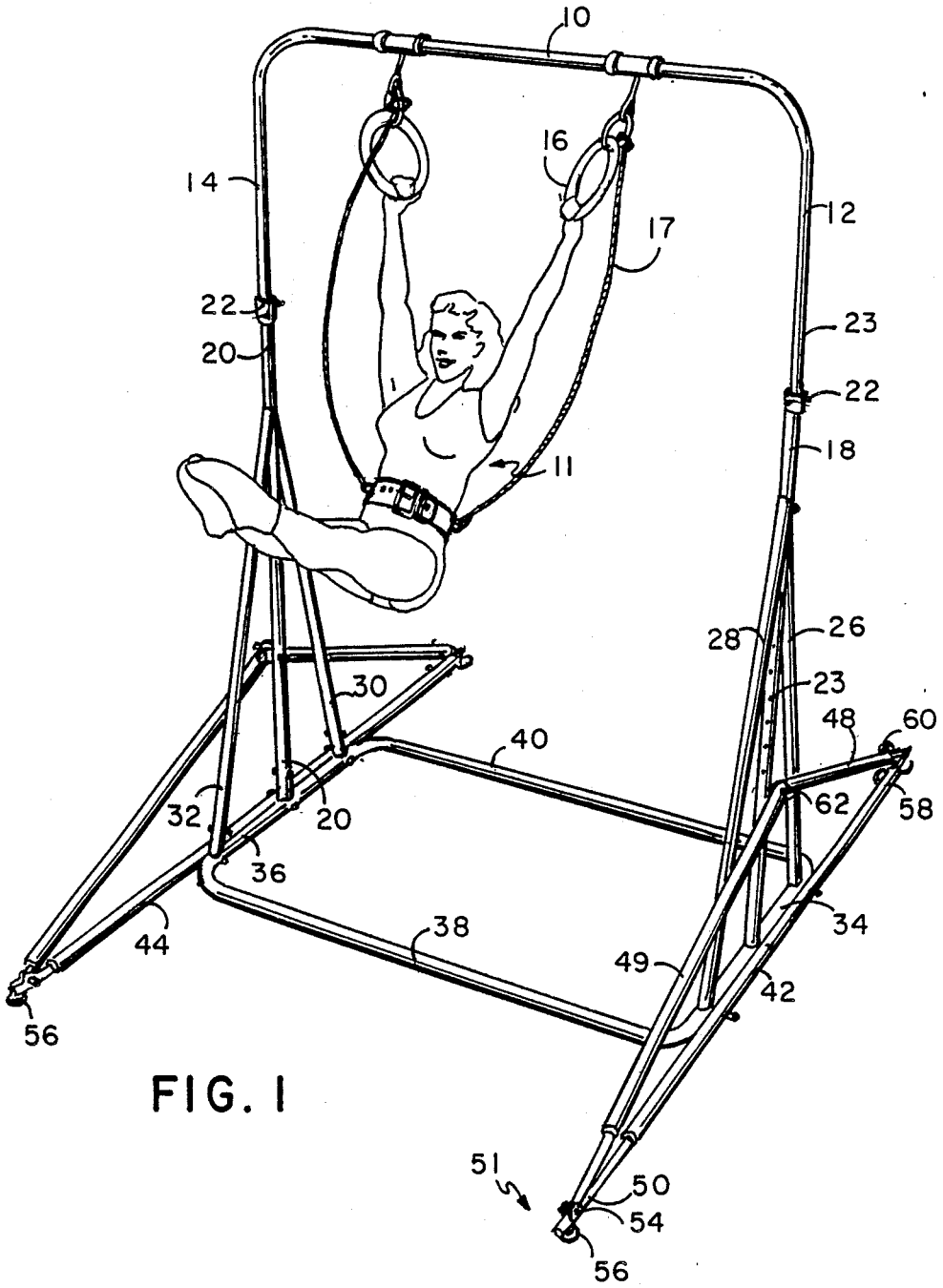
FIG. 1 illustrates one embodiment of the device of this invention in use.
Figure 1A:
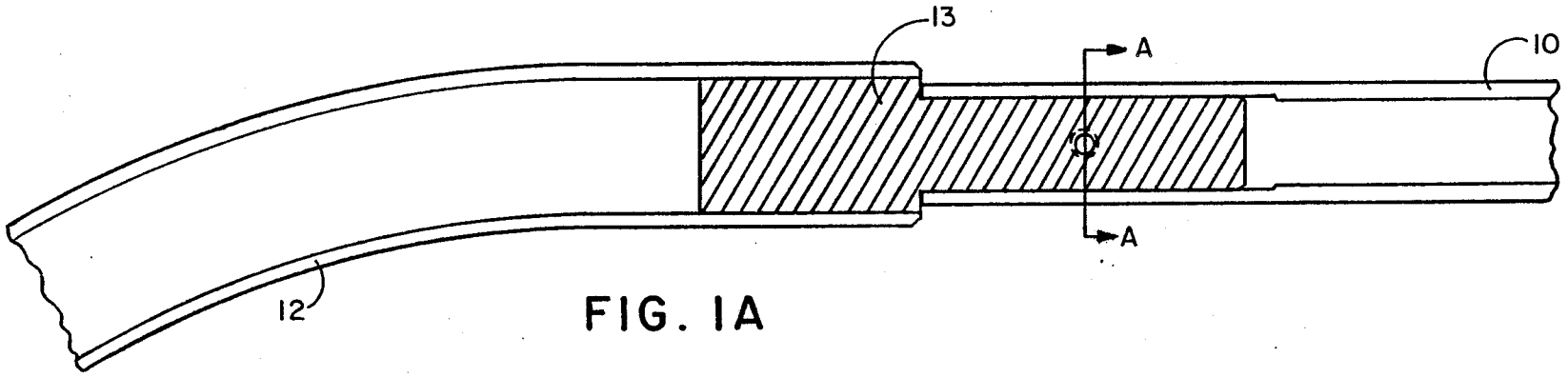
FIG. 1A illustrates an alternate method of bar attachment to the uprights.
Figure 1B:
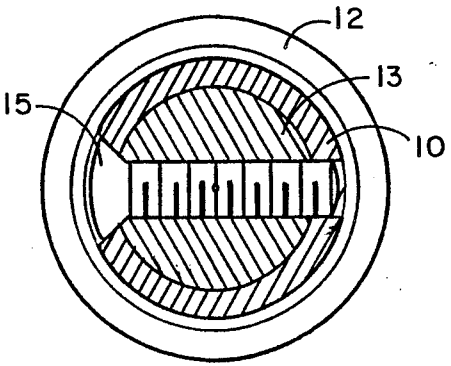
FIG. 1B illustrates a cross-sectional view through A—A of FIG. 1.

FIG. 1 illustrates a perspective view showing individual 11 swinging from the device of this invention. Ring members 16 are seen pivotally attached to bar 10. Individual 11 is seen in a full arc swing. The device of this invention must support the user while swinging without any undesirable rocking movements. Bar 10 is attached to first and second vertical support elements 12 and 14 which elements as shown in this embodiment can be a continuous portion of bar 10 or can comprise other separate elements attached thereto. FIG. 1A shows one embodiment where upright 12 curves to a horizontal position and has a solid insert 13 which protrudes therefrom and over which cross-bar 10 is positioned. As seen in FIG. 1B which is a section A—A of FIG. 1A is cross-bar 10 which can be held in position by screw 15 which is recessed so as not to protrude beyond cross-bar 10 so that exercise equipment or users will not catch on it. First and second vertical support elements 12 and 14 are supported respectively by first and second uprights 18 and 20 and are held in adjustable relationship therewith such as by having a plurality of apertures 23 in each vertical support element with a bolt member passing through each of the uprights to tighten against or to pass into a selected aperture in the vertical support elements, forming bar height adjustments 22. In this fashion horizontal bar 10 can be raised or lowered to a desired height. Equivalent bar height adjustment means can also accomplish the desired results of this invention. First and second uprights 18 and 20 extend downward to the floor where they are respectively attached to first and second inner base members 34 and 36. Inner base members 34 and 36 are cross-connected to one another by cross members 38 and 40. For further structural support on each side, inclined braces such as 26 and 28 can be affixed to upright 18 and extend down to be attached at points near the ends of inner base 34. This structure forms a rigid well-supported upright member and similar inclined braces 30 and 32 can be affixed to inner base 36 and to the opposite upright 20. This basic structure supports the horizontal bar for many uses but is not suitable for wide-angle swinging because when the body swings in a wide arc, the center of gravity of the unit moves beyond the cross member and the unit will tip. To avoid tipping of the device, elongated base members 42 and 44 are affixed to inner base members 34 and 36, respectively. The elongated base members should extend to near or beyond the end point of the user's swing at its widest arc so as to prevent the device from tipping or otherwise having undesirable movements when in use.

Figure 3:
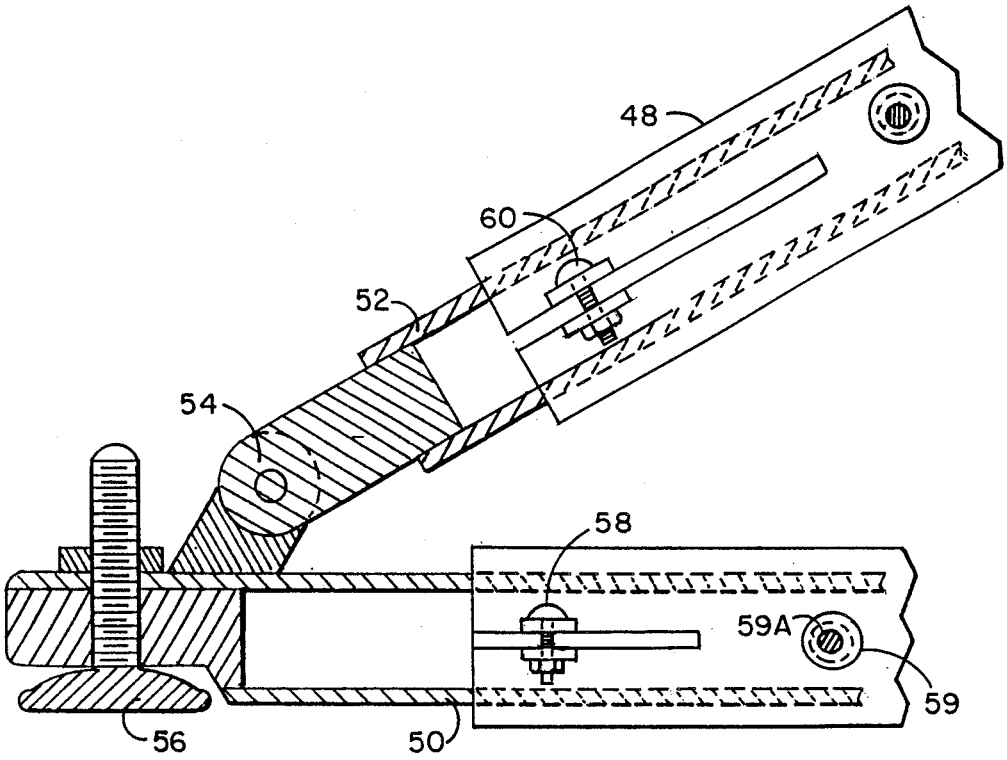
FIG. 3 illustrates a closeup view of the hinge and leg members of one of the base extension member utilized in the device of this invention.

As mentioned above, it is often desirable to be able to exercise in one's home and not to have to travel to gymnasiums to do gymnastic workouts involving wide-angle swinging from bars. To allow an individual to work out in the smaller rooms of a home, it is the goal of this invention that base members 42 and 44 be extendable and retractable. This objective can be accomplished in a first embodiment as seen in FIG. 1 with reference to one bottom corner 51 thereof by utilizing base members having adjustable outward positioning thereof incorporating base extension members which extend beyond the elongated bases on each end thereof. Each of the extending ends of the elongated base members has similar adjustable support members and structure so that the description of the base extension at bottom corner 51 is the same for the other three elongated base member ends. Seen in FIG. 4, which is a side view of the embodiment illustrated in FIG. 1, is base extension 50 which telescopically slides within elongated base 42. It can be fixed in any desired extended position by passing bolt 59 through apertures such as 59*a* in elongated base 42 and then through aligned apertures in base extension 50 with bolt 59 passing out the aperture in the other side of elongated base 42 opposite aperture 59*a*. Bolt 59 can be held in place by a nut or spring clip or equivalent fastening means. Squeeze fittings 58 and 60 which can be tightened by a bolt or other equivalent means act to prevent up and down movement during swinging of the base extensions which might otherwise rattle when the device is used. At the end of base extension member 50 is adjustable leg member 56 also seen in FIG. 3 which can be attached by threaded screw means and is adjustable by rotating so that it can be raised or lowered. For additional support to the unit an extension brace member can be attached to the base extension member. Such adjustable extension brace member creates in this embodiment a triangular support with the upright and adds tremendous strength to the unit as a whole. These extension brace members have an upper extension brace 48 which is affixed to upright 18 by bolt means 62 or equivalent which allow it to pivot at its attachment point. Lower extension brace member 52 is telescopically and slidably adjustable within upper extension brace 48 and when in its desired position, can be secured by a bolt or other equivalent attachment means as described above. Hinge 54 pivotally attaches base extension 50 and lower extension brace 52 to one another and allows them to change angles in relation to one another so that as base extension 50 is extended from base 42, lower extension brace 52 extends from upper extension brace 48.

To place the device in its storage mode, each extension brace such as extension base 50 is maneuvered as far as it will go into base 42 or in some embodiments they can be removed, and the entire device can be moved to a side of the room where a swing or hanging bed as previously mentioned can be hung from bar 10 so that the device can be used as a piece of furniture within the room itself.

Figure 4:
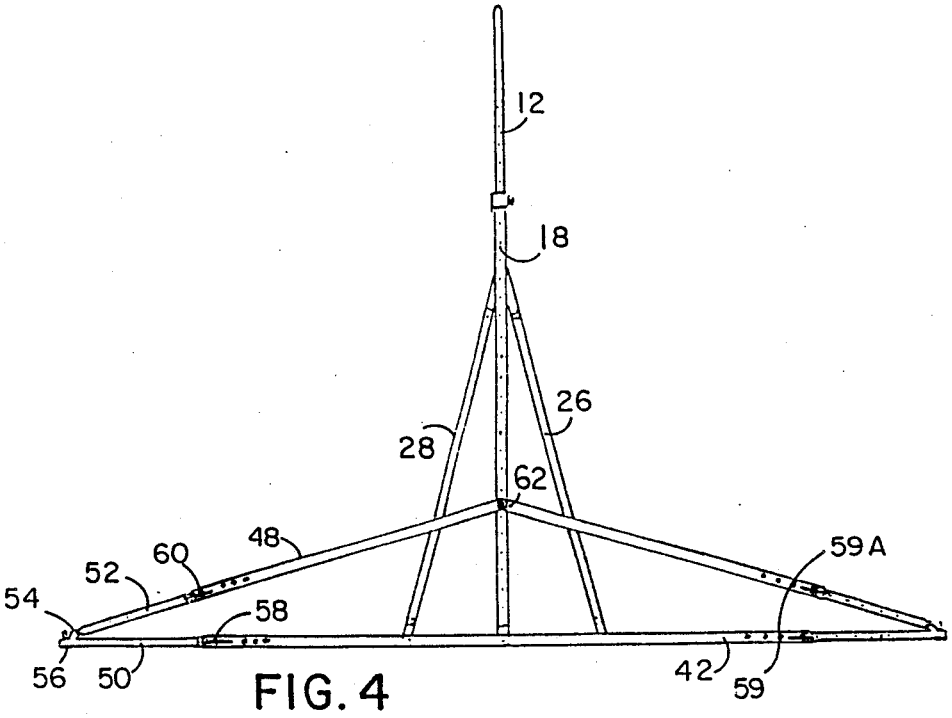
FIG. 4 illustrates a side view of the device of FIG. 1 with the extension members extended.
Figure 5:
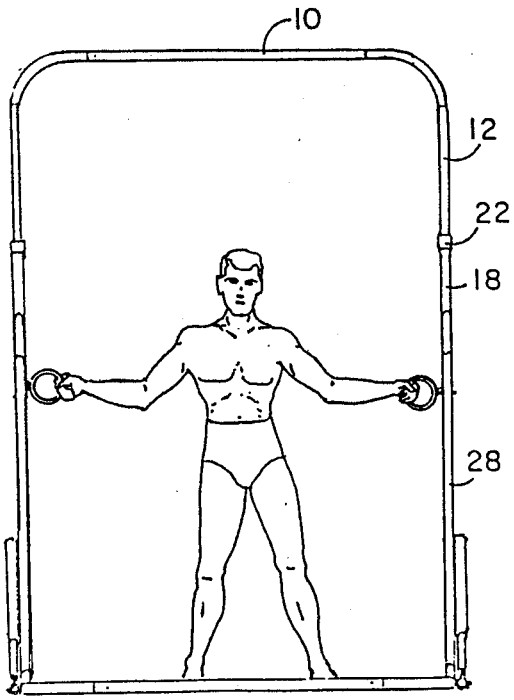
FIG. 5 illustrates a front end view of the device of FIG. 1 with a man's figure therein.
Figure 6:
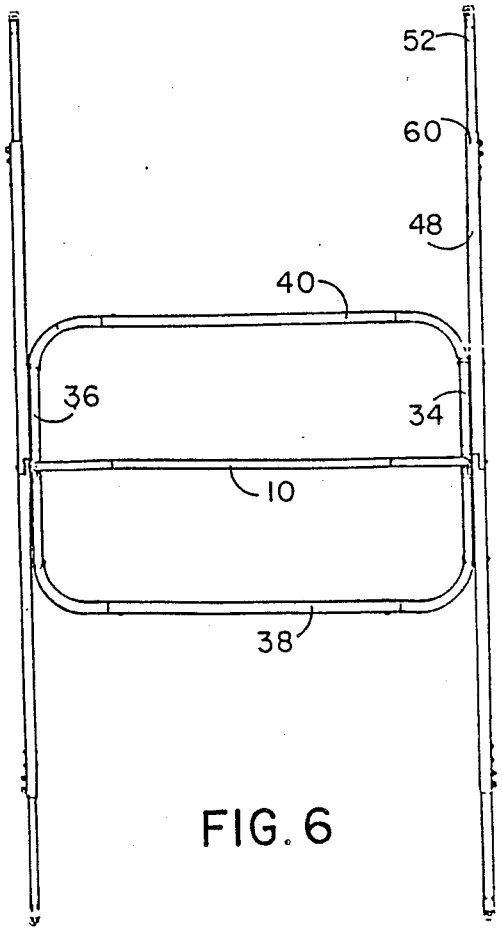
FIG. 6 illustrates a top view of the device of FIG. 4.

FIG. 5 illustrates an end view of the embodiment of FIG. 4 with an individual standing in place to show the relative size of the device to a user. As stated previously, the size of the framework of the device is important and it has been found that a space of 6 ft. between the uprights allows for proper extension of the user during many exercises as will be described below. The height of the uprights can be adjustable from 7 to 9 ft. to fit inside most rooms and to accommodate the user exercising thereon. As mentioned, the height of the crossbar can be adjustable. The extension members can be extended on the floor up to approximately 11.5 ft. although some embodiments do not need as long an extension. FIG. 6 illustrates a top view of the embodiment of FIG. 5. It has been found that one can reach bar 10 by standing on the extension braces in order to attach various apparatuses to the crossbar. In some embodiment, though, apertures can be provided in the uprights through which steps on mounting bolts can be attached in order to reach the crossbar easily.

Figure 2:
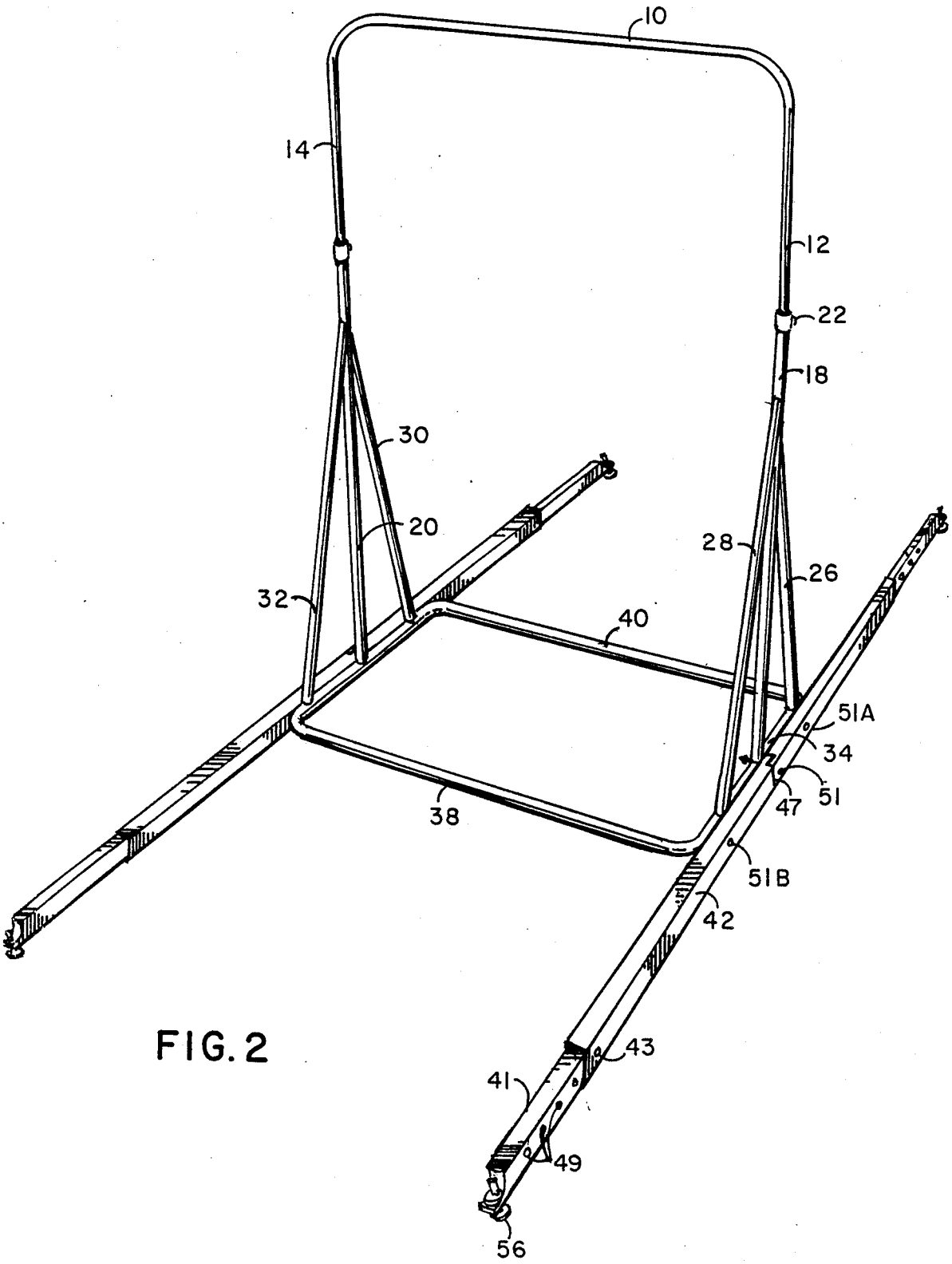
FIG. 2 illustrates another embodiment of the device of this invention with extension members extended.

FIG. 2 illustrates an alternate embodiment with base 42 having base extensions 41 which telescopically slide into and out of base 42. These base extensions can be retained in position by bolt member 43 which passes through aperatures aligned in base extension 41 and base 42. In this embodiment the base is of rectangular cross-section as are the base extensions. The base can be formed of two members overlapped at their junctions 47 with bolt 51 passing therethrough into inner base 34. Bolts 51*a* and 51*b* can also hold each side of base 42 to inner base 34. In the embodiment shown base 42 can be 9 ft. long. To position base extension member such as 41 they are moved out of base 42 to a desired position. One then fixes them in that position by passing bolt 43 through an aperture in the side end of base 42 into one of a selected aperture 49 in base extension 41. Adjustable legs 56 can also be utilized in this embodiment which embodiment is also illustrated in side view in FIG. 7, in top view in FIG. 9 and end view in FIG. 8.

In the embodiment of FIG. 2 the base extensions can be retracted into base 42 for storage and/or bolts 51, 51*a* and 51*b* can be removed and base 42 can be removed from inner base 34. When these steps are accomplished on both sides of the device the floor print of the unit is much smaller and the device can be stored easily.

Figure 10:
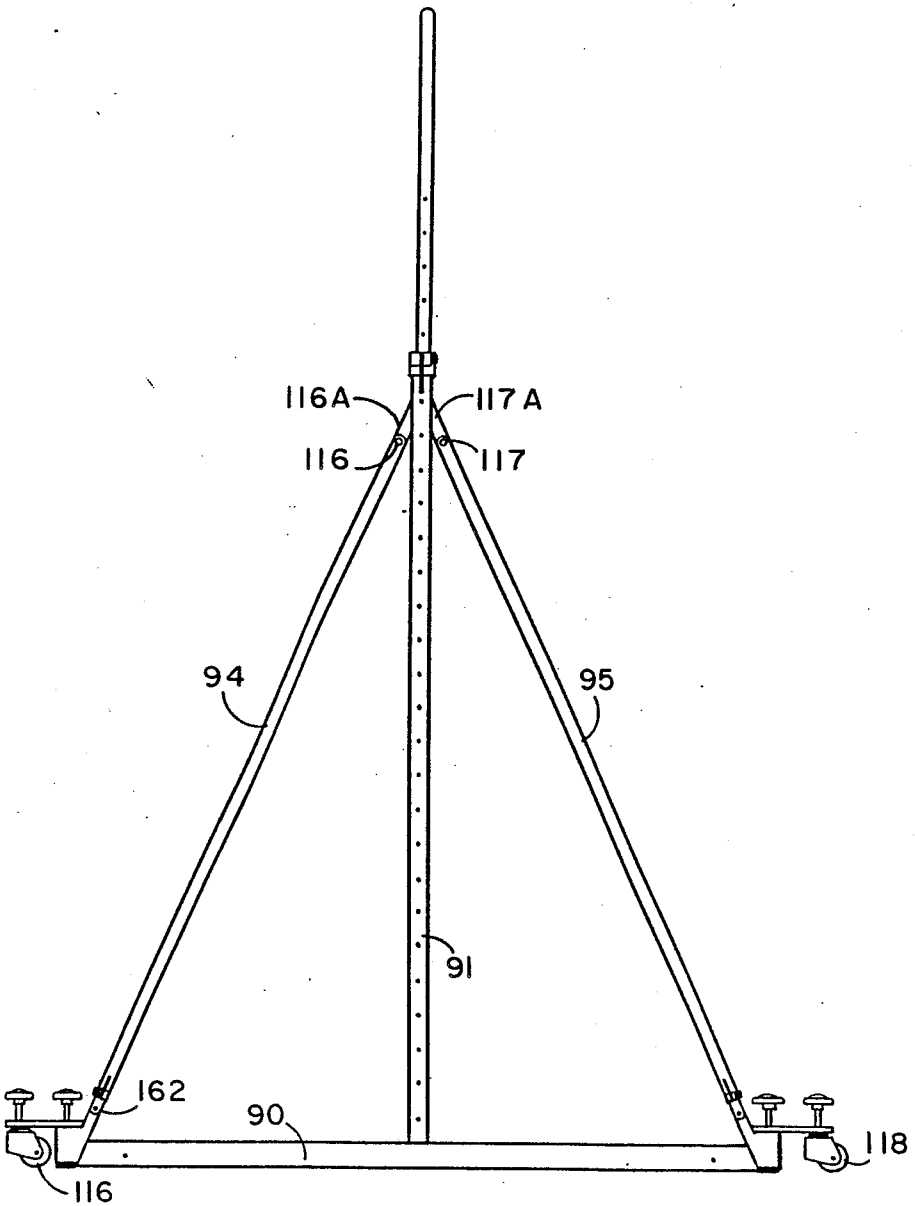
FIG. 10 illustrates a further embodiment of the device of this invention.
Figure 10A:
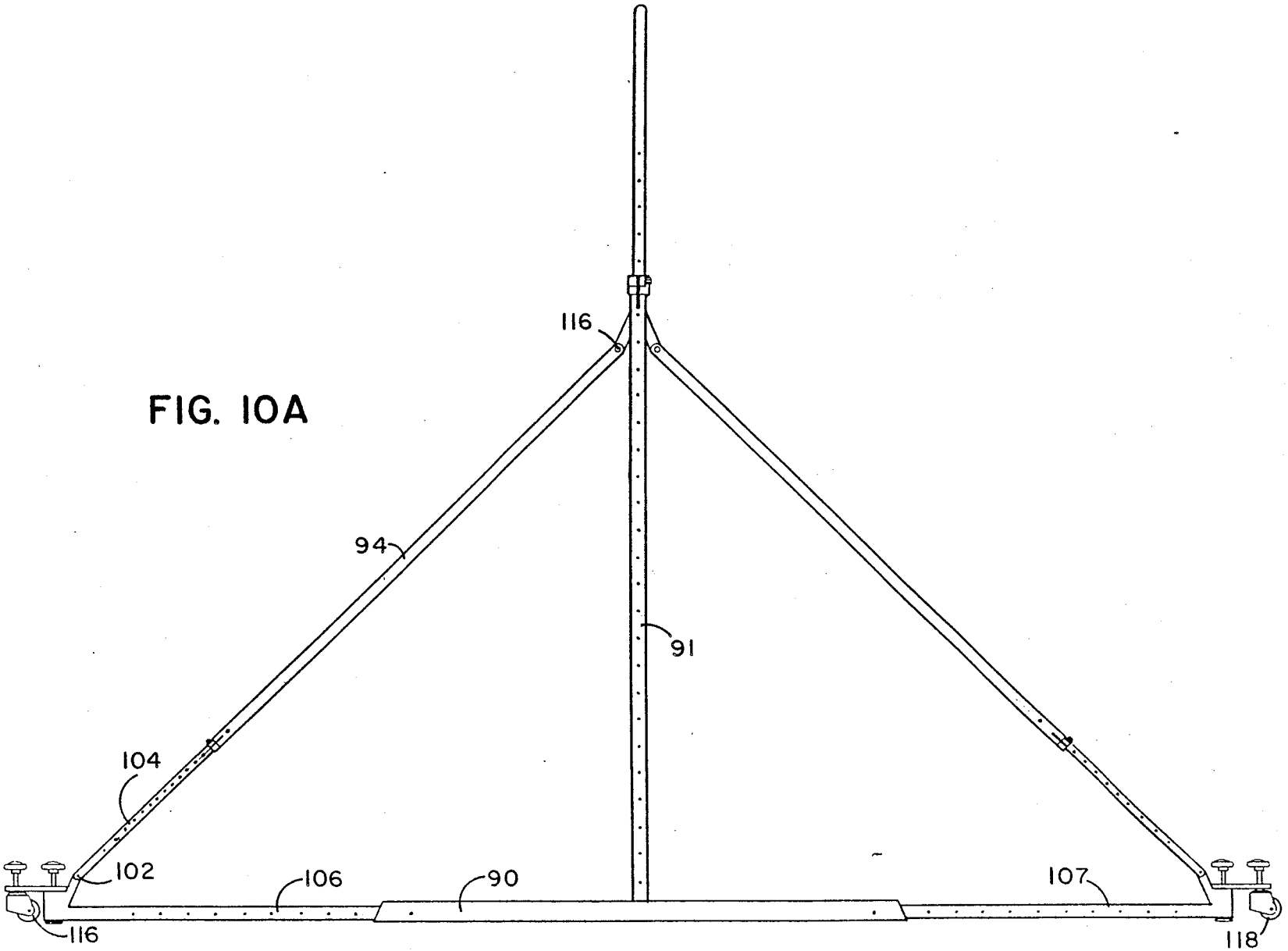
FIG. 10*a* illustrates the device of FIG. 10 with its extension members extended.

FIG. 10 illustrates another alternate embodiment with shortened base 90. In this version the inclined braces and inner bases are not utilized. Upright 91 is attached directly to base 90. Extension base 106, extended as shown in FIG. 10*a*, extends telescopically out of base 90. Extension base 106 is attached at hinge 102 to an extension brace 104 which is telescopically housed in upper extension brace 94 which in turn is hingeably attached to upright 91 at hinge 116. Base 90 is hollow and receives the extension bases 106 and 107 side by side therein when extension bases are pushed inwards. Wheels 116 and 118 can be provided at the ends of base 90 or at the ends of extension bases 106 and 107 and are positioned in one mode to extend below the bottom of base 90 so as to cause base 90, the extension bases and the rest of the structure thereabove to be movable on such wheels.

Figure 11:
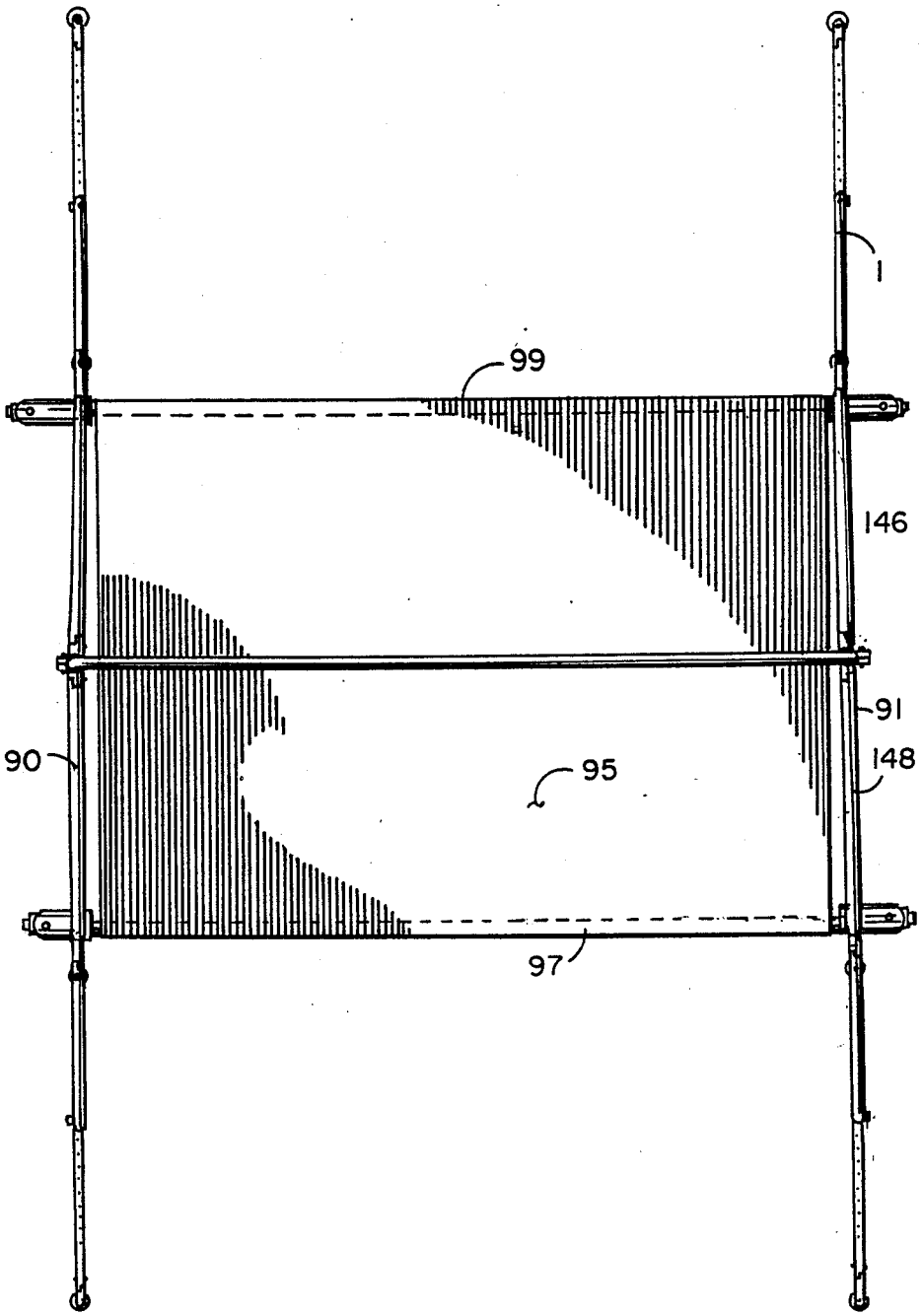
FIG. 11 illustrates a top view of the device of FIG. 10*a* showing a base panel.

FIG. 11 illustrates a top view of FIG. 10*a* with panel 95 added which rests on bases 90 and 91 and on cross members 97 and 99. Also wheels 116 have been moved to a position at the end of the bases. One stands on this panel when using the unit so that in some exercises, such as lifting spring members attached to the upright, the unit will not move as it is, in addition to being held down by its own weight, also held down by the weight of its user. This panel can also be suspended from overhead pivot bearings and used as a platform for a bed or couch.

Figure 12:
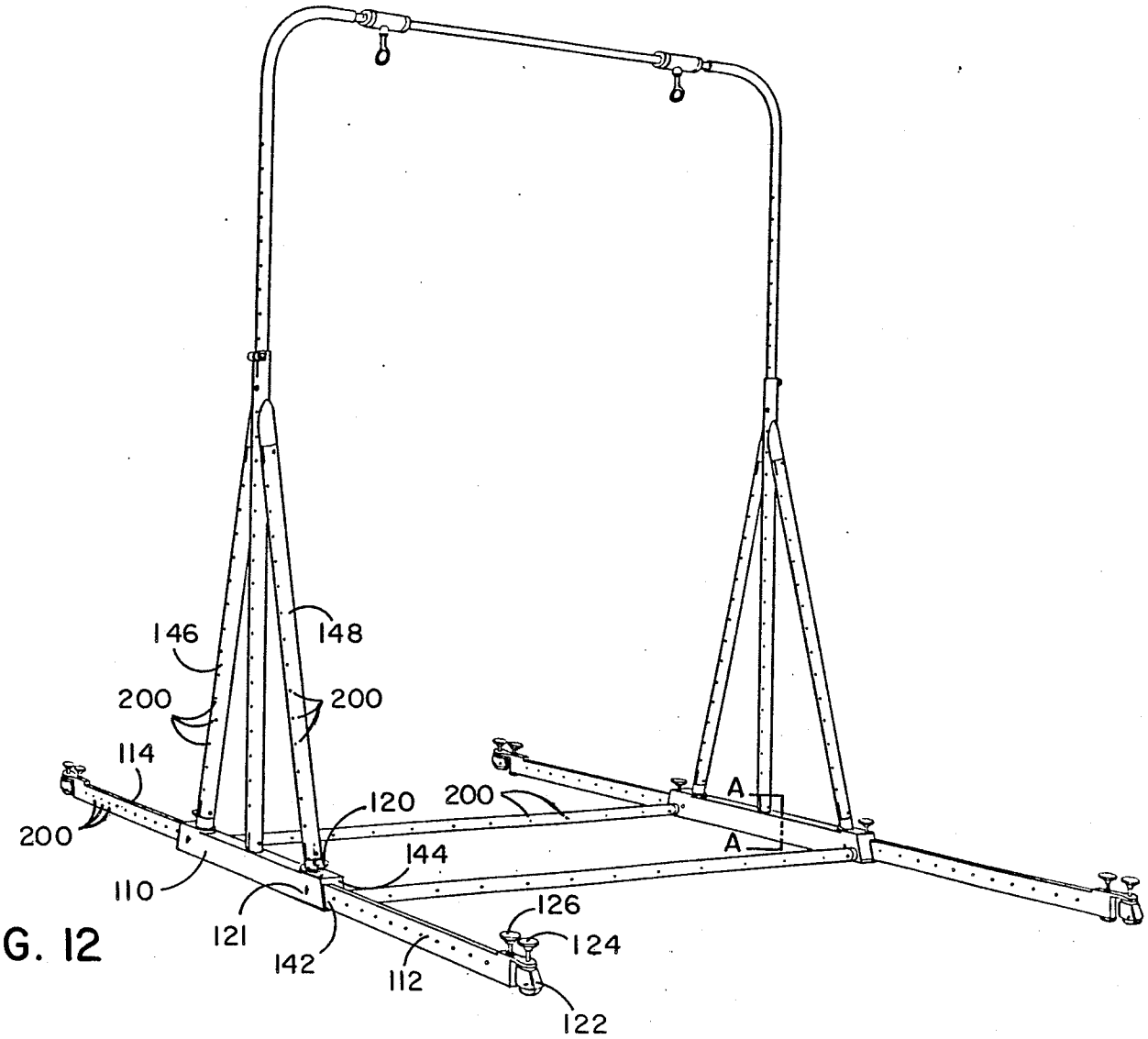
FIG. 12 illustrates a yet further embodiment of the device of this invention.

FIG. 12 shows an alternate embodiment of the device of this invention having a shortened base member 110 which has base extension members 112 and 114 contained telescopically therein adapted to slide by one another and to be held side by side within base member 110 when the device is in its storage mode.

Figure 13:
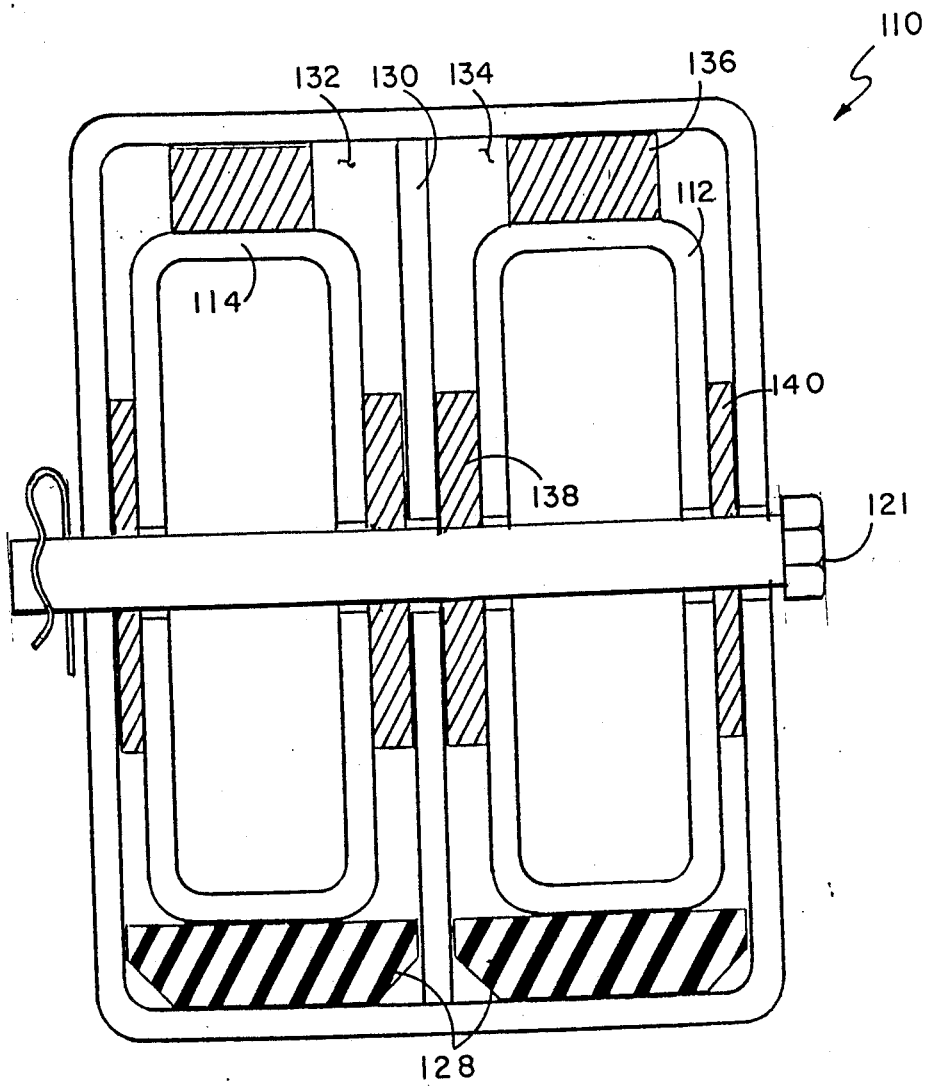
FIG. 13 illustrates a cross-sectional view through AA of the base member of the device seen in FIG. 12.
Figure 14:
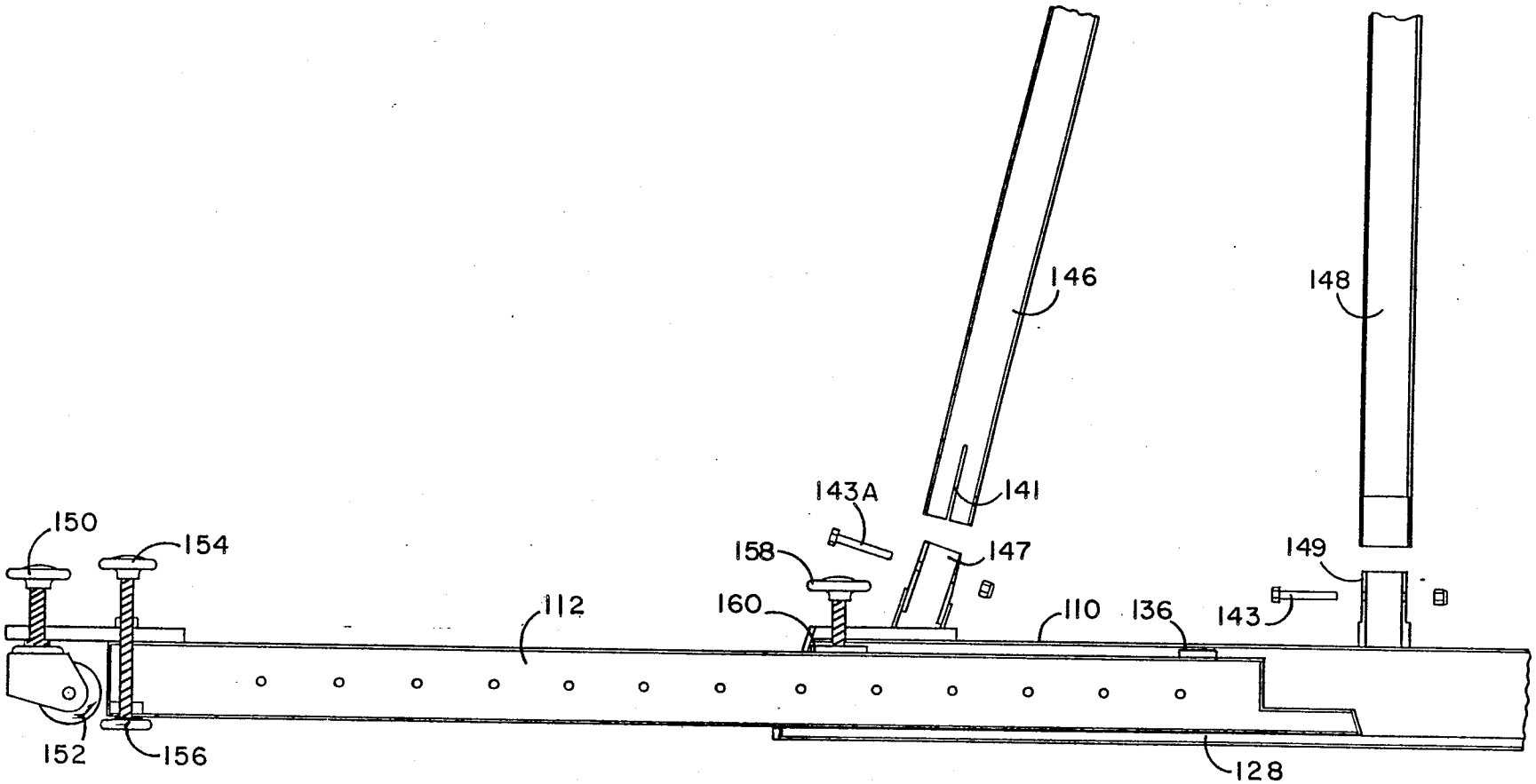
FIG. 14 is a side cutaway view of the wheel and leg members of the device of FIG. 12.

FIG. 13 is a depiction through a cross section A—A of shortened base member 110 wherein is seen extension members 112 and 114 when pushed therein and held side-by-side. Tension screws can be tightened at the end of each side of base member 110 to hold the extension members in position once they have been pulled out of the base member to prevent undesirable vertical movement. Bolt 121 through the side of shortened base member 110 into extension member 112 holds extension member 112 in its selected extended position. Also seen are wheels 122 which, in the embodiment shown, are positioned at the ends of the shortened base member 110. The wheels also have a threaded top member with a hand wheel 124 which adjusts their height in relation to the bottom of the shortened base member. By rotating hand wheel 124, the wheels can be lowered below the bottom of the shortened base member thereby raising the entire unit to rest on the wheels themselves so that the unit can easily be wheeled from one place to another. The wheels can be alternatively positioned at the ends of the extension members and can have the same type of adjustment screw. It should be noted that the adjustment members have adjustment means 126 which can be screwed by a handwheel to be below the bottom of wheel 122 and which can raise the extension member off the floor or can be used to accommodate the unit to use on uneven flooring. The embodiment in FIG. 12 does not have adjustable inclined braces. Its fixed braces can be removable for disassembly of the unit for shipping as seen in FIG. 14, and such braces can run from the base member to the upright vertical support and be affixed thereto to firmly hold the unit together. With regard to the construction of the base member 110, bottom rubbing pads 128 as seen in FIG. 13 can be provided for the extension members 112 and 114 to run on and the chamber within the base member within which the extension members pass can be divided by a divider 130 into two compartments 132 and 134 in which each base extension member slides. A top rubbing block 136 on a portion of the extension member can be provided of steel or equivalent material so as to prevent any upward or downward movement of the extension member which movement would be undesirable. Bottom rubbing block 128 can be made of plastic and can extend the full length of the shortened base member for easy sliding of the extension members in and out of the shortened base member 110. Other rubbing pads such as the inner rubbing block 138 and outer rubbing block 140 can be provided on the extension member to prevent any undesirable lateral wiggling movement within their respective compartments. These rubbing blocks can be of steel or equivalent welded to the extension member such as rubbing block 136. The end of the shortened base member 110 can have an aperture 142 therein for the passage therethrough of the base extension member and the other portion of the end 144 can be blocked so that the extension member extended on the opposite side will not pass entirely through the shortened base member and will always protrude from the proper side. As seen in a top view of FIG. 11, the inclined braces 146 and 148 of this embodiment extend down to near the ends of the shortened base member 110. Shortened base member 110 has a certain thickness when used in a rectangular configuration such as seen but it should be noted that other configurations such as circles having two circular compartments for receipt of two circular extension members would form an equivalent design and would be considered to be within the spirit and scope of the invention herein.

FIG. 14 shows details in a cut-away view of one of the embodiments of an end of the unit as illustrated in FIG. 12 wherein the hand-operated raising and lowering of the wheels can be accomplished at the end of the extension member 112 by rotating handle member 150 which would raise or lower wheel 152. The wheel as seen in this embodiment extends beyond the end of the base extension member 112 and is seen in an up position. Also the locking pad can be seen with a handle 154 which can raise or lower floor pad 156 to hold securely the unit in place. Floor pad 156 can have rubber on the bottom thereof to prevent sliding. Also seen in this view is the locking handle 158 which locks pad 160 against the base extension member 112 so as to tighten when it is in its extended position so as to hold it securely in place. The rubbing blocks 138 and 140 as seen in FIG. 13 positioned on a portion of base extension member 112 on the inside of the base member 110 prevent lateral movement thereof and when the tension knob 158 is tightened, the top rubbing block 136 also prevents any up and down movement to hold the base extension member securely in place during exercises. In FIG. 10 upper braces 94 and 95 are movable and at hinges 116 and 117 which pivot on members **116*a* and 117*a* which in turn extend from vertical support 91 which embodiment differs from that having the upper extension braces attached directly to the vertical support. It is envisioned that all of the embodiments of this invention can be disassembled such as the embodiment of FIG. 14 where braces 146 and upright 148 can be detached from the shortened base member 110. One manner of accomplishing this is to provide these members in a tubular form which can be either rectangular or round in cross-section and to provide projection members 147 and 149 extending upwards a short distance from the base member in the direction of the braces and uprights. One then positions these braces and uprights such as braces 146 and upright 148 on such projection members 147 and 149 to form a solid, but disassemblable, structure. Bolts such as bolts 143 and 143*a* can hold uprights 146 and 148 to projection members 147 and 149, respectively. A split such as split 141** can be provided in the braces and uprights to help them fit onto the projection members.

Figure 14A:
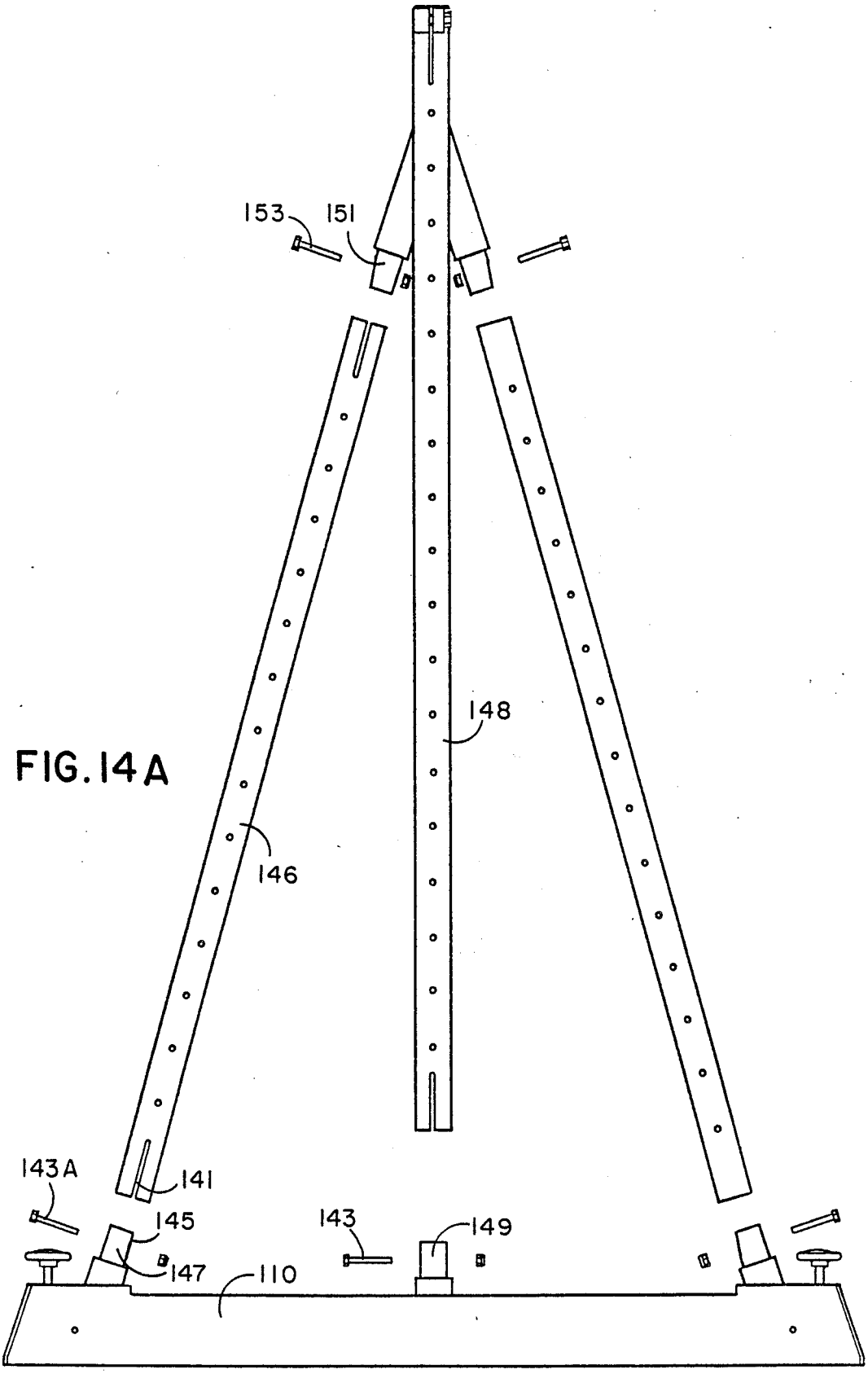
FIG. 14A illustrates the side of the embodiment of FIG. 12 showing structure disassembled.

In FIG. 14A more aspects of disassembly are illustrated. Projection member 147 can have a slope 145 at its side which makes the insertion of brace 146 thereon much easier. All of the attachment points of the projection members into braces can utilize such sloped projection members. As the braces are attached at their bottoms to projection members such as projection 151 extending to the upright above, with a bolt and nut 153 to retain the brace in place.

In FIG. 1 pivot bearings are disclosed which are very important for the use of the device of this invention for some exercises. The exercises that can be performed on the device of this invention include many brachiating and stretching exercises. In this regard the pivots containing special bearing members are used for easy swinging motions. These pivots smooth out the action of the exercises and prevent jerking motions which could cause joint, muscle or ligament strains. It is quite difficult to hang by one's hands and pivot from the palms and fingers of one's hands back and forth. To do so creates much strain on the arms and is not an efficient way to swing from a horizontal bar. Therefore the pivot bearings of this invention contain self-lubricating bearing inserts, eliminating the need for oil or grease lubricants which could drip and cause loss of grip on the apparatus or soil home furnishings. The pivot bearings also provide a place to attach additional equipment such as padded rings for a comfortable and variable grip. The pivots further allow for safety harness lines to pass through the receptacles of the pivot unit which safety harness can be utilized either by oneself, as described further below, or with a spotter person to prevent any danger from falling from the bar or to prevent danger from any wrap-up problem where traditional ceiling mounted safety ropes wrap around the user or equipment. These unique pivot bearing features allow many individuals of various ages who do not possess traditional gymnastic skills to derive the traditional whole body fitness benefits of gymnastics.

Figure 15:
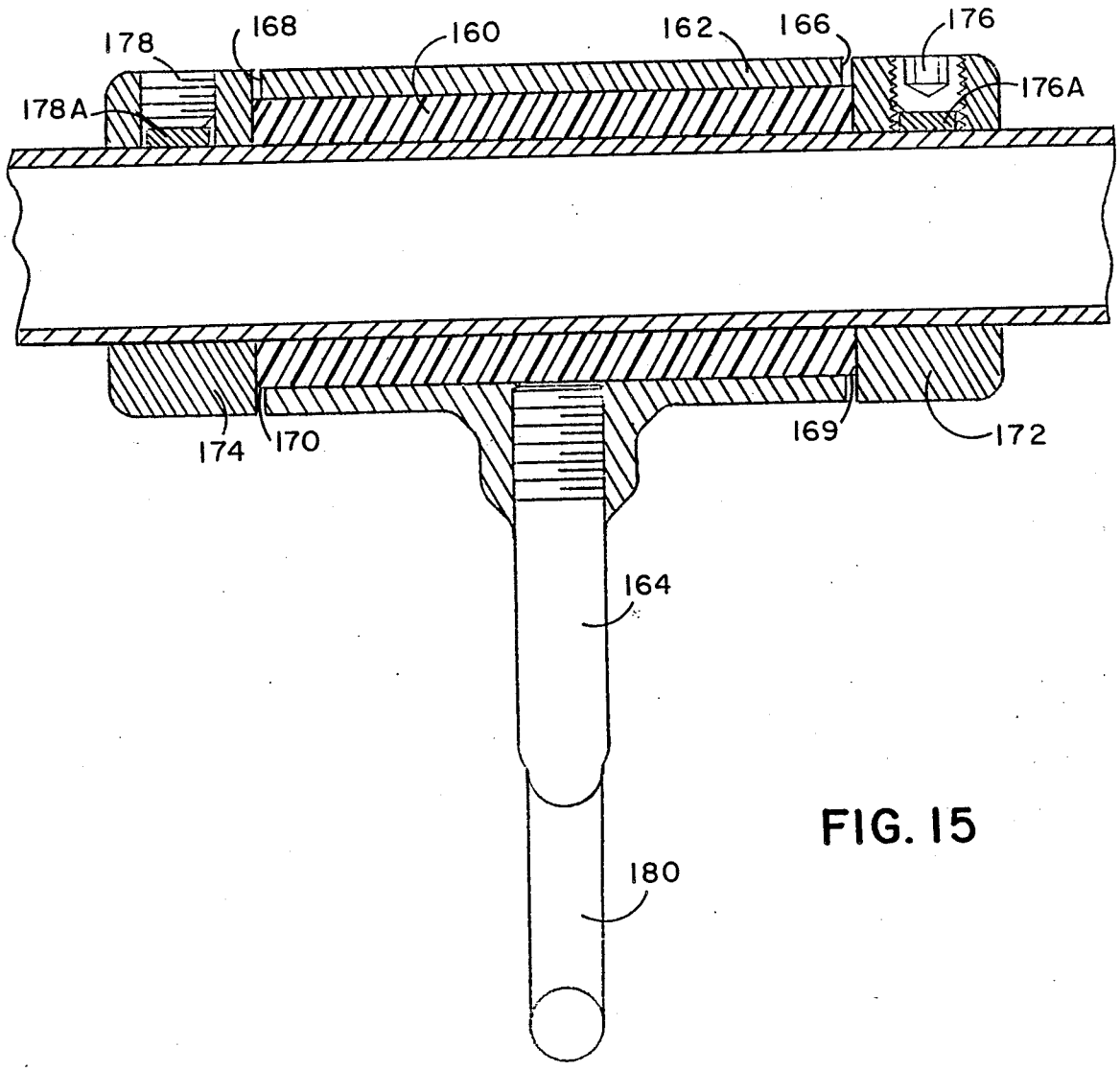
FIG. 15 illustrates a cross-section of a pivot device on the cross-bar.

FIG. 15 illustrates a cross-sectional view of a pivot bearing of this invention. Two pivot bearings are usually utilized which are positioned on the horizontal bar 10 and can be utilized on any of the embodiments of this invention. Seen in this view is a Delrin bearing 160 which is a cylinder surrounding the horizontal bar in a close relation fit thereto. The pivot bearing body 162 extends tightly around Delrin bearing 160 and has located thereon welded eyebolt 164. Delrin bearing 160 extends beyond each end 166 and 168 of the body of the pivot 162 to form bearing extensions 170 and 169. Up to the ends of the end of bearing 160 are positioned end members 172 and 174 which also surround the horizontal bar and which are moved up to contact the ends 170 and 169 of bearing 160. The end caps are provided with set screws 176 and 178 which tighten against brass bushings 176*a* and 178*a*, respectively which allow the end members to be tightened in such position directly onto the horizontal bar 10. The use of brass bushings 176*a* and 178*a* against the bar prevents the set screws from digging into or otherwise marring the brass. These end caps are tightened in contact with the ends of the Delrin bearing or bearing of equivalent material which moves on the horizontal bar 10. Pivot body 162 moves with bearing 160 around horizontal bar 10 and the bearing 160 also moves in relation to the end caps 172 and 174 which are tightened in place thereagainst. Easy pivoting is created because of the low friction between the Delrin material and the hard metal material of bar 10 and end cap members 172 and 174. The pivot bearings of the design of this invention allow for smooth low-friction pendulum swinging with a fluid directional transition to prevent stress, strain and shock to muscles, joints and ligaments and the pivot bearings and eye bolts as described below allow for a self-contained free-floating safety harness which can be used in place of the traditional spotting coaches who control safety harness lines. Eye bolt 164 can be of steel or equivalent and can be threaded into a member at the bottom of the pivot body 162 and can have eye member 180 at the bottom thereof so that the items to be suspended from the horizontal bar can be affixed therethrough. The plastic Delrin or any other equivalent long-wearing self-lubricating plastic allows easy and smooth rotation, and the structure design eliminates any sideward movement of the pivot member because of its containment by the end caps 172 and 174.

Figure 16:
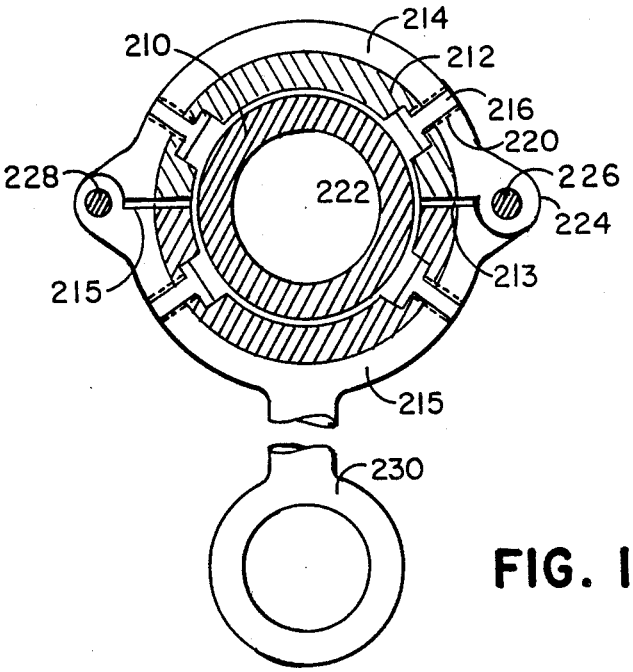
FIG. 16 is a side view of a split hinged overhead pivot bearing.
Figure 17:
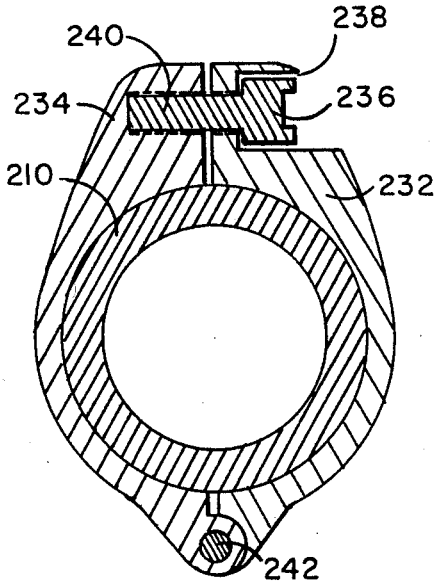
FIG. 17 is a slightly enlarged view of a bearing end cap for use with the split hinged overhead pivot bearing of FIG. 16.

FIG. 16 illustrates a split hinged overhead pivot bearing which can be utilized in situations where the overhead crossbar does not have means to split it apart into sections for insertion of a solid Delrin bearing and solid pivot bearing body as seen in FIG. 15. In the embodiment of FIG. 16 the pivot bearing can be installed on the bar since the pivot bearing includes means to open the bearing and to insert it around the bar. In this view is seen a horizontal crossbar 210 in cross-section around which is disposed a Delrin bearing 212 which is split at points 213 and 215 and is attached on each side by countersunk screws 216 into the respective portions of the metal pivot bearing housing 214 and 215. In this way the Delrin bearings are each attached to half of the housing and when the quick-release removable retaining pin 228 is removed, the metal pivot bearing housings 214 and 215 rotate open at hinge 224 on a hinge pin 226 through that hinge and can then be opened and closed around the horizontal crossbar 210 with the quick release removable retaining pin 228 reinserted so that the horizontal crossbar is held within the Delrin bearing even though it is a split bearing at this point. In this way one does not have to dismantle the unit or this type of split hinged overhead pivot bearing can be used on units where the upright ends are curved around and there is no means for opening to get access to a horizontal portion of the crossbar. The eye bolt section as in the solid pivot bearing body extends from a section such as bearing housing 215 down to the eye bolt for attachment of the desired accessories. An end cap is also needed because the structure operates as described above with the solid housing as seen in FIG. 15 and the end cap can be comprises of two housing members 232 and 234 which hinge around hinge pin 242 and surround the horizontal bar 210. Seen in this view slightly enlarged it is important that the hinged split bearing end cap be closed securely and to that end threaded aperture 240 is provided in half of the body 234 with screw 236 passing through a portion of body 232 to hold the two bodies securely together around horizontal crossbar. As can be seen aperture 238 is provided in the body section 232 so that the heads of the screw can be countersunk to avoid any contact therewith by the user.

Figure 18:
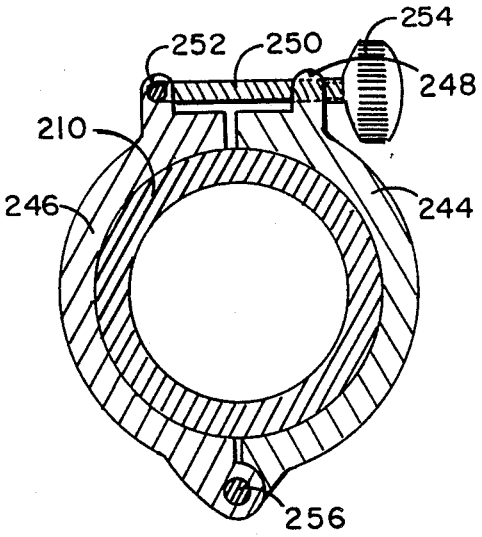
FIG. 18 is an alternate embodiment of the pivot bearing end cap of FIG. 17.

A further alternate embodiment is seen in FIG. 18 wherein the body sections 244 and 246 are closed around the horizontal bar 210 at hinge 256 and another type of closure element having a shaft attached at hinge 252 to side 246 can be rotated into slot 248 in the opposite side and tightened in position by a hand-wheel with screw threads 254 for tightening so that it can be tightened and held in place by tightening and then released by loosening hand wheel 254 and lifting the shaft 250 out of slot 248.

It is important in many exercises to provide safety harnesses which are ropes or straps to the body of the exerciser to prevent the individual from losing his or her grip on the exercise device and falling to the ground thereby injuring himself or herself. In the embodiment of this invention using pivot bearings as seen in FIG. 1, a rope 17 can be affixed from a waist attachment belt to the pivot bearing and tightened thereon by an individual without help. Then when exercising, should the individual lose his grasp, the rope will prevent the individual from falling to the ground as the individual's belt will fall no further than the distance of the individual standing and the individual can regain control and stand up again should he slip off the unit. Of course the traditional spotting coaching safety harnesses can be used wherein the ropes run through the pivot eye-bolts and to a coach holding them from the side who can activate them should the individual exercising fall from the unit.

Figure 19:
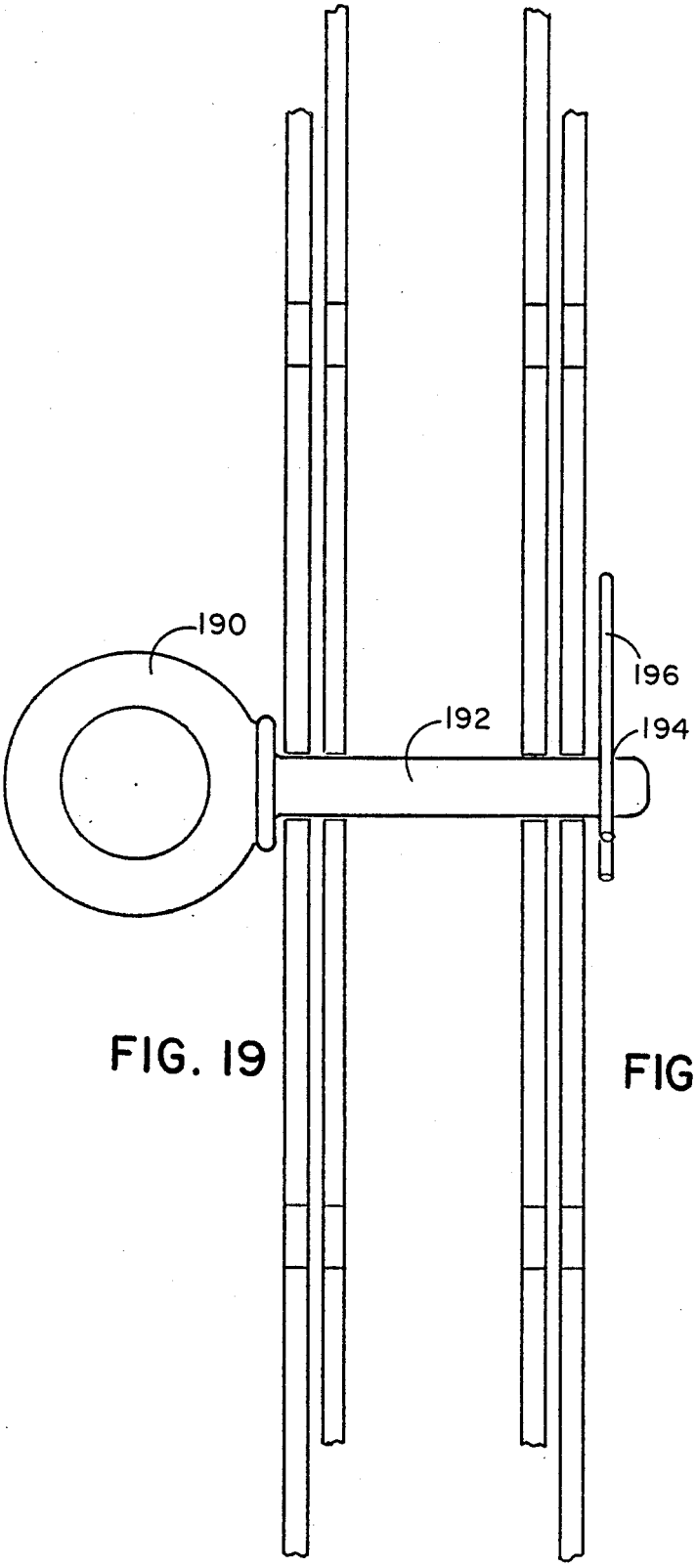
FIG. 19 is a cross-sectional side view of a rotatable eye bolt.
Figure 19A:
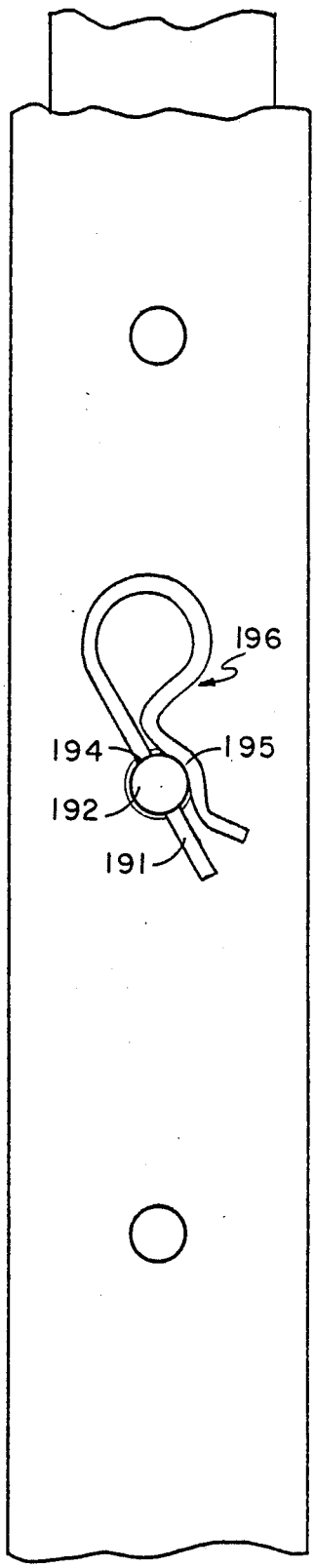
FIG. 19A is a side view of the upright of FIG. 19.

FIG. 19 illustrates a cross-sectional side view of a rotatable eye-bolt. It should be noted that throughout the device of this invention apertures can be formed within the frames, whether on the uprights, vertical supports, inclined braces, and even the cross members and base members. These apertures can provide a place for the insertion of one or more free-floating eye-bolt members 190 which are used for attaching various apparatuses to the device of this invention. The eye-bolt body 192 is of a design which is unthreaded and which can pass through the parallel holes in the frame and can be retained in position by having an aperture 194 formed at its end through which a tempered hairpin cotter springclip 196 is inserted. The bend 195 seen in and end view in FIG. 19A in clip body 196 in the portion that extends around the exterior of shaft 192 is adapted to fit around and be retained against the shaft 192 to hold the clip 196 in place when clip shaft 191 is passed through the aperture 194 in the shaft 192 of eye bolt 190. In this way even when rotating the bend 195 retains the clip 196 in position even if it should be upside down because a portion of that bend is snuggly retained against the shaft in semi-circular fashion and thereby even with rotation, the hairspring cotter spring clip 196 will not fall out. This arrangement functions in a secure yet quick-release manner making numerous changes of location of apparatus attachment and of the apparatus itself practical during a single exercise session. In this fashion the eye bolt rotates freely 360 degrees in a vertical plane and, can rotate with equipment therein about 180 degrees being the minimal rotation on a horizontal and lateral plane which equals or exceeds the desired range of motion to allow for freedom of movement when using equipment attached to the eye bolts of this invention.

Figure 20:
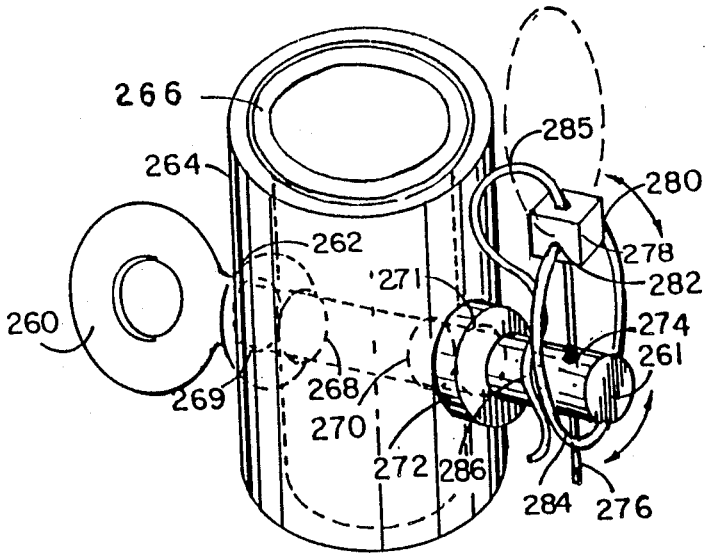
FIG. 20 is a side view of a rotatable eye bolt with double safety system.
Figure 22:
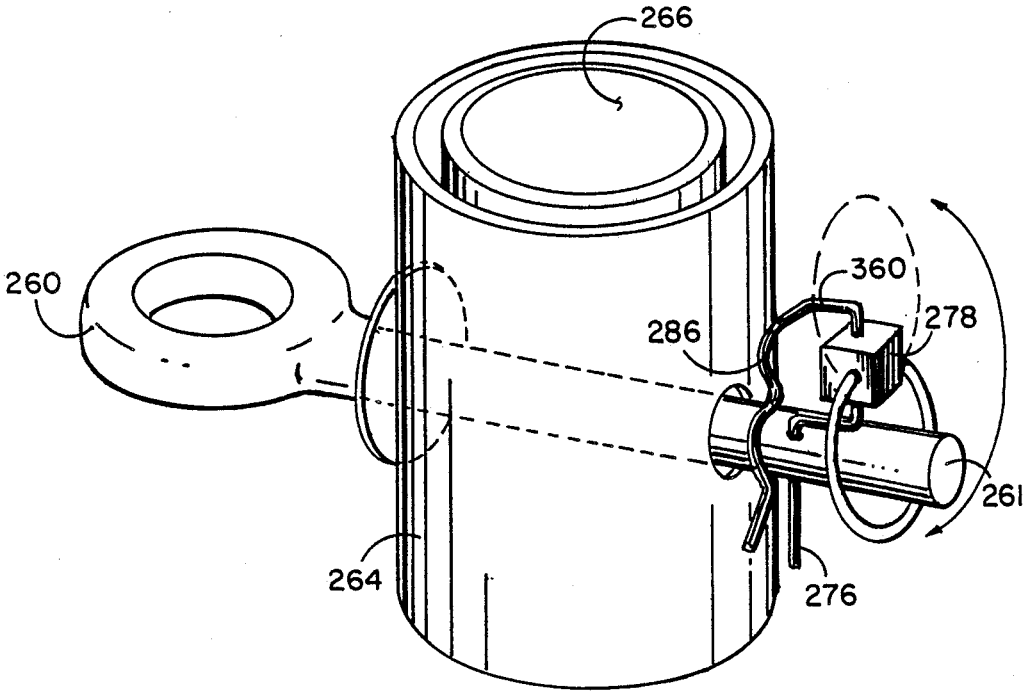
FIG. 22 is an alternate embodiment of FIG. 20.

FIG. 20 illustrates an alternate embodiment of a rotatable eye bolt with a double safety system which is highly desirable in this invention to prevent accidental release of the rotatable eye bolt when pressure is placed thereon from the exercise attachments which pass therethrough. Should a release occur accidentally, injury could be sustained by a user and therefore it is important that the rotatable eye bolt be positively secured to the framework of the device of this invention. In FIG. 20 the rotatable eye bolt 260 is seen secured through an aperture in the upright which is formed from an inner upright 266 and outer upright 264 where the inner upright can be adjusted up and down but has therein an aperture 268 to align with the aperture 269 in the outer upright with corresponding apertures 270 and 271 on the other side of the inner upright 266 and outer upright 264. In this way the shaft 261 of eye bolt 260 can be passed through both sets of apertures which are in alignment. A flange 262 can separate the body of eye bolt 260 from the aperture so that it can rotate smoothly at that end. Also a close-fitting metal or plastic washer 272 can be provided on the other side of the outer upright 264 where it passes through aperture 271. This keeps the inside face of the safety latch from interferring in any way with the rotation of the eye bolt. The safety latch incorporates a double safety system. An aperture 274 is provided through the shaft 261 of eye bolt 260 through which is passed the shaft 276 of a hairspring cotterpin springclip the body of which has a curve 286 which when passed over the shaft 261 of the eye bolt 260 locks thereto. An additional safety feature is presented by a block member 278 with apertures formed on each side thereof adapted to receive the ends of an open circular safety ring 284 which is spring-like material. Block member 278 is fitted on shaft 276 before curve 286. In one embodiment shaft 276 as seen in FIG. 22 can have a bend 360 perpendicular to curve 286 which bend returns to the original position of shaft 276 to offset block member 278 away from washer 272 and upright 264 so as not to contact such members during operation of eye bolt 260. Apertures 280 and 282 on block member 278 are offset from one another, both laterally and horizontally, and when the ends of spring clip 284 are inserted therein, it is under tension and the spring clip 284 remains in whatever position it is placed or moved to. The spring clip is adapted, once inserted the apertures 280 and 282 to be rotated downward and around the shaft 261. To do this, the cotter spring clip 285 must be fully inserted within the aperture 274 to allow for its curve 286 to engage around the body of shaft 261 because otherwise one would not be able to rotate the ring 284 around the end of shaft 261 so that the use of this circular ring also causes an absolute insertion of the cotter safety clip similar to the one as seen in FIG. 19 but with the additional double safety should a rotation of the eye bolt occur, the ring will prevent the cotter pin from falling out of the shaft aperture 274 because the ring will rest upon the shaft. This double safety feature with a positive interlock when the second ring is engaged of the hairpin cotter is a significant improvement in safety clips.

Figure 21:
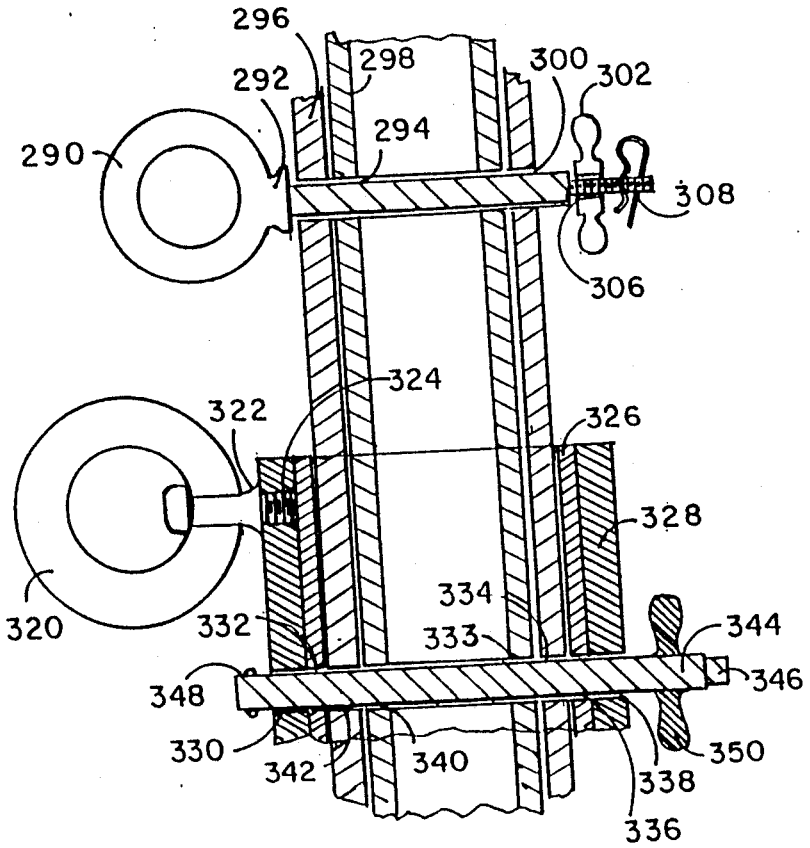
FIG. 21 is a side view of an alternate embodiment of a rotatable side bolt and a movable side bolt embodying a collar.

Another alternative clip can be utilized as seen in FIG. 21 where eye bolt 290 is passing through apertures in the uprights 296 and 298. These apertures such as aperture 294 as in the previous view are aligned and the end of the eye bolt 290 having a collar 292 to ease its rotation at the eye bolt end, the other end that passes beyond the aperture 300 in the upright 296 can be threaded 306 to receive a threaded wing nut 302 and a hairpin cotter spring clip 308 can fit through an aperture formed in the end with a portion of the clip curving around the shaft as previously described to hold it in place. In some embodiments it may be desirable that a swivel ring be provided which would operate in a manner similar to an eye bolt except that it can be on a collar. This collar can be important to some embodiments with a steel collar 328 extending around the uprights and having within it a plastic buffer insert 326 to prevent any clanking noise or marring from movement of the collar. The swivel ring can be attached on a post 322 and screwed into an aperture 324 in the steel collar 328. This collar can be moved up and down and can be locked or tightened in position by bolts or equivalent against the interior of the upright or it can be aligned with apertures in the inner and outer uprights such as apertures 342, 340, 333 and 334 so that apertures formed in the insert 326 such apertures being 336 and 332 are aligned with apertures in the solid steel collar 338 and 330 forming a complete pass-through aperture into which a spring-loaded quick-release pin 344 can be inserted which has clip means 348 at its end which when inserted, protrude and the handles of the spring release pin 350 can be used to grasp it, pass it in and out quickly and easily by releasing of button 346 which pulls the extruding pins 348 inwards so that the spring-loaded quick-release pin 344 can be pulled in and out of all the aligned apertures quickly.

The plurality of apertures 200 as seen in FIG. 12 provided through the braces, crossmembers, and uprights can be used for attachment of spring members or other equivalent elastic materials to perform the traditional resistance exercises for muscular development, such as presses, squats and curls. Separate hand grips 202 allow alternating or synchronized arm or leg movements, and an unweighted bar may be attached to elastic members attached to the unit near the floor to simulate the traditional barbell when lifted by the user. This system of resistance strength training allows for freedom of movement and the resulting development of muscular strength, power and endurance; and overall balance and coordination from using free weights with the convenience and safety of a weight machine. Further the plurality of apertures 200 make the device of this invention a free-standing support system for the attachment of traditional gymnasium equipment such as slant board, ballet barre or heavy punching bag.

As a framework for stretching, alignment and self-traction, the device of this invention improves upon the doorframes, chainlink fences, pipes, stairsteps, towels and other points of resistance or tethering generally suggested by experts, and is in many applications equivalent to a human partner or trainer. By pushing or pulling against the framework of the device or against any apparatus attached from the apertures, such as roller-grip handles, stirrups, cuffs, straps or cables and pulleys, the body may be fully extended or flexed in any direction or combination of directions with complete control and safety for the purposes of warm-up and cool-down during exercise, development and maintenance of correct posture, proper skeletal alignment, relief of stress and tension, and therapy and rehabilitation of musculoskeletal injuries or handicaps. In addition there are direct applications to physical and occupational developmental therapy.

The most advanced professional and scientific theories of physical fitness emphasize unified whole body fitness combining stretching, flexibility, and a full natural range of movement with functional strength, power and enduance. It is important to develop kinesthetic awareness and utilize a dynamic range of motion which equals the desired range of motion which will stretch ligaments and muscles in order to exercise the whole body. One problem with small exercise devices is that they will exercise isolated muscles, but it has been found more important to use whole body movements to exercise major muscle groups. Whole movements are further thought to be better for exercises because the mid-course corrector muscles and the core stabilizer muscles are utilized with such large exercise motions, and total coordination and balance are increased. Therefore it is important that instead of separately stretching and then exercising, one both exercise and incorporate the stretching elements within the exercises to help elongate the muscles which exercise combination is more advantageous to the joints and ligaments, and results in functional whole body fitness.

The unique combination of proportion, stability and multiple free-floating attachment means into the apertures common to all the embodiments of the device of this invention, generates new whole body exercise which stretch and strengthen at the same time. These standing exercises use one's own bodyweight leveraged against and/or tethered to the framework of the device or apparatus attached thereto, and propelled by rhythmic whole body movements, which utilize the natural mobility of the joints and elasticity of the muscles. These exercises may be done with an anaerobic-type cadence and greater leverage to emphasize power and strength, or with an aerobic-type cadence and less leverage to emphasize muscular endurance; but always with full extension and flexibility. These exercises also develop coordination, balance and agility. These simultaneous stretching and strengthening exercises use similar positions and apparatus as the stretching exercises, but with arms and legs bent and dynamic isokinetic movement to produce the reciprocating eccentric and concentric muscular contractions which lengthen and strengthen the musculature. These movements include rocking, twisting, swaying, leaning, thrusting, dancing and their back and forth, lateral, angled or reciprocating variations. All these innovative exercises have the same whole body fitness benefits as gymnastics, but have an even greater factor of safety and require an even lower beginning skill level than required by traditional or modified gymnastics exercises performed on the device of this invention.

Figure 7:
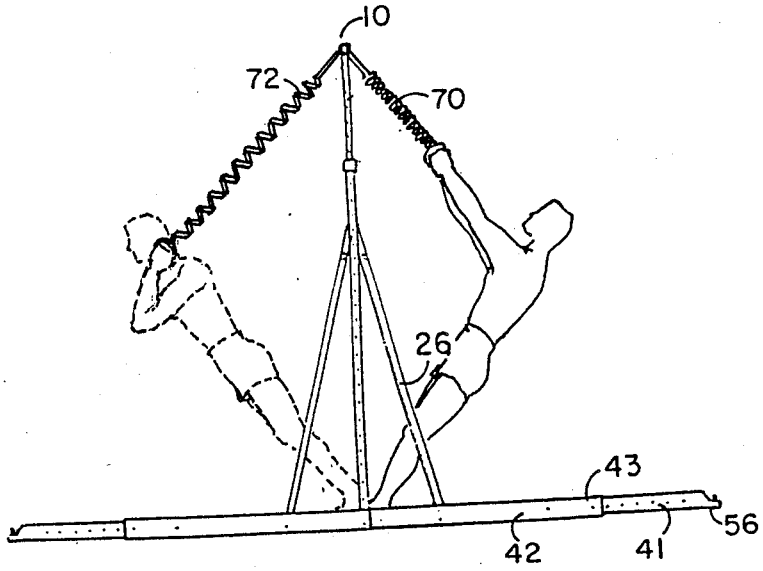
FIG. 7 illustrates a side view of the device of FIG. 2.
Figure 8:
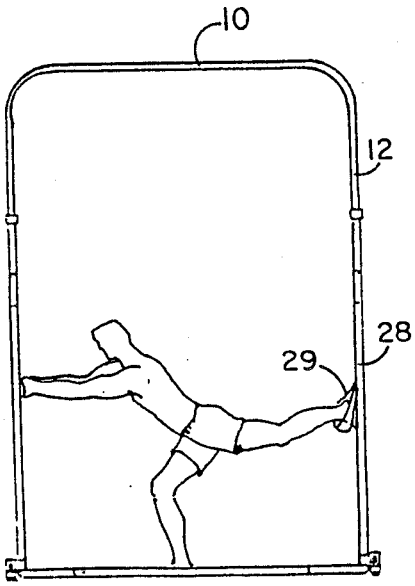
FIG. 8 illustrates a front end view of the device of FIG. 2.
Figure 9:
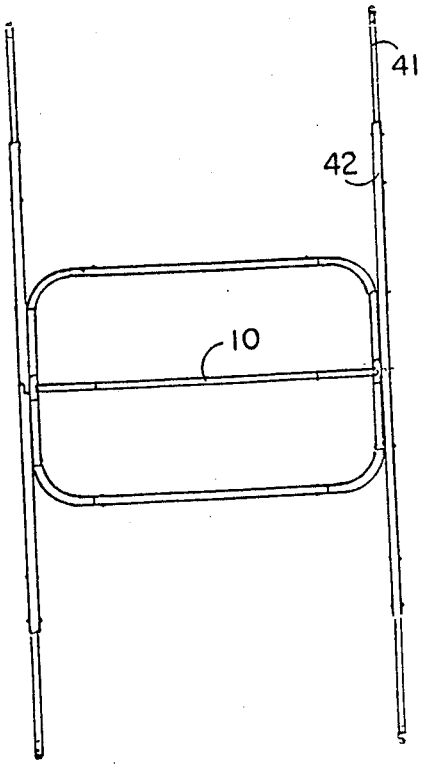
FIG. 9 illustrates a top view of the device of FIG. 2.

In addition elastic members 70 and 72 seen in FIG. 7 hanging from bar 10 can be utilized for exercising by pulling on them while resting the feet on the ground and leaning forward and then backward to allow elastic members 80 to cause the body to swing back and forth in an arc from the ground rather than from the bar. In FIG. 8 another exercise can be performed on the device of this invention with the individual grasping each brace and using a loop 29 to hold one foot at a time for stretching the legs. The unique structure of the braces and their spacing from the opposite upright allow sufficient distance for this exercise to be performed.

Although the present invention has been described with reference to particular embodiments, it will be apparent to those skilled in the art that variations and modifications can be substituted therefor without departing from the principles and spirit of the invention.

I claim:

1. In an exercise system, including a horizontally disposed bar, a pair of upright support structures disposed on opposite ends of said bar, and a pair of base members to provide structural rigidity to the exercise device, the improvement comprising:

attachment means on the upright support structures and the horizontal bar, including receptacles defining a plurality of fixable locations on both said upright support structures and said horizontal bar for connection of various kinesthetic exercising apparatus in various arrangements suitable for a variety of kinesthetic exercises; and a plurality of distinct kinesthetic exercise apparatus for performing kinesthetic exercises, including means for quick releasable and replaceable coupling of said kinesthetic exercise apparatus to the exercise system in a freely rotatable manner via said attachment means, such that the exercise system can be employed to accommodate a variety of kinesthic exercises.

2. The system of claim 1 wherein the upright support structures each further include a vertical upright member and a pair of diagonal brace members coupled to said vertical member at one end and coupled to a base member at the other end.

3. The system of claim 1 wherein the receptacles further include a plurality of apertures disposed within the upright support structure.

4. The system of claim 1 wherein the receptacles further include a plurality of apertures disposed within the base members.

5. The system of claim 1 wherein the attachment means includes a plurality of apertures and further comprises:

at least one aperture-engaging, rotatable eyebolt, removably engagable in a selected one of said apertures, the eyebolt having a ring for connection of the kinesthetic exercising device, and a shaft passing through the aperture;

and locking pin for securing said shaft within a selected aperture; and a safety means for preventing said locking pin from inadvertent disengagement.

6. The system of claim 1 wherein the attachment means includes a plurality of apertures and further comprises:

at least one collar element disposed around a member of the system, having a swivel ring attached thereto for connection of the kinesthetic exercising device and further having a pair of apertures alignable with a selected aperture on said member:

and locking pin for securing said collar to said member by passage through a selected set of apertures; and a safety means for preventing said locking pin from inadvertent disengagement.

7. The device of claim 1 wherein the receptacles further include at least one overhead attachment means on said horizontal bar for supporting a kinesthetic exercise device.

8. The system of claim 7 wherein the overhead attachment means further comprises:

at least one rotatable bearing means disposed about said horizontal bar for supporting an exercise device, the bearing means further including a low friction, inner sleeve for engagement of said bar, and at least one releasable locking means whereby the bearing means can be releasably secured at selective positions for rotation about the bar.

9. The system of claim 1 wherein the system further includes:

a pair of base extension members disposed side-by-side within each of the base members, wherein said base extension members are extendible and retractable in opposite directions and can be fixed at variable lengths; and means for engaging said base extension members in a selected position of extension.

* * * * *